US007319840B2

(12) United States Patent
Matsumoto

(10) Patent No.: US 7,319,840 B2
(45) Date of Patent: Jan. 15, 2008

(54) INDUCTION HEATING FIXING DEVICE AND IMAGE FORMING APPARATUS

(75) Inventor: Hiroshi Matsumoto, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 124 days.

(21) Appl. No.: 11/209,801

(22) Filed: Aug. 24, 2005

(65) Prior Publication Data

US 2006/0093413 A1 May 4, 2006

(30) Foreign Application Priority Data

Nov. 4, 2004 (JP) ..... 2004-320841

(51) Int. Cl.
*G03G 15/20* (2006.01)

(52) U.S. Cl. ..... 399/330; 399/335

(58) Field of Classification Search ..... 399/320, 399/328, 330, 334, 335, 338; 219/216, 619; 347/156

See application file for complete search history.

(56) References Cited

U.S. PATENT DOCUMENTS

| | | | | |
|---|---|---|---|---|
| 6,463,252 | B2 * | 10/2002 | Omoto et al. | 399/330 |
| 6,725,000 | B2 * | 4/2004 | Takagi et al. | 399/330 X |
| 7,065,315 | B2 * | 6/2006 | Kinouchi et al. | 399/334 |
| 2004/0165916 | A1 * | 8/2004 | Takagi et al. | 399/328 |

* cited by examiner

*Primary Examiner*—Sandra L. Brase
(74) *Attorney, Agent, or Firm*—Finnegan, Henderson, Farabow, Garrett & Dunner, L.L.P.

(57) ABSTRACT

An induction heating fixing device includes: a heating member for heating a recording medium while rotating along a paper passing direction, and an induction heating unit for heating the heating member, wherein: the heating unit has a plurality of induction coils arranged by being divided in an axial direction of the heating member, the plurality of induction coils comprises an internal induction coil arranged inside the heating member and an external induction coil arranged outside the heating member, and the internal induction coil and the external induction coil are arranged so as to overlap each other in the axial direction of the heating member.

4 Claims, 4 Drawing Sheets

INDUCTION HEATING FIXING DEVICE AND IMAGE FORMING APPARATUS

BACKGROUND OF THE INVENTION

1. Field of the Invention

The present invention relates to an image forming apparatus such as a copier. More specifically, the present invention relates to improved technology of a fixing device adopting an induction heating system.

2. Description of Related Art

An image forming apparatus has a fixing device for heat-fixing a toner image on a recording medium. In the image forming apparatus, the fixing device adopts an induction heating system for realizing energy-saving by remarkably shorting a warming-up time or by reducing consumption energy during standby.

The fixing device using the induction heating system comprises a conductive heating roller where a magnetic flux generating unit using the induction heating system is provided as a heat source, and a pressure roller for forming a nip portion in pressure contact with the heating roller.

The induction heating magnetic flux generating unit comprises a horizontally long core that extends in an axial direction of the heating roller and an induction coil that is wound around this core. An prior magnetic flux generating unit is formed to a length corresponding to a maximum width of a recording medium in the axial direction, in which the whole heating roller (the maximum width) is heated during a fixing operation. Therefore, when passing large-sized recording paper after passing small-sized recording paper, heat absorption by the recording paper is not performed at a portion corresponding to a non-paper passing portion formed at the previous paper passing (when passing the small-sized paper), and heating is performed while keeping the state. As a result, the following problems occur. That is, nonuniformity of a fixing temperature is caused in the axial direction of the heating roller and fixing failure such as hot off-set occurs due to a high temperature. Further, malfunction detection stop of machines is caused due to abnormal temperature rise. For solving the problems, a method for arranging an induction heating magnetic flux generating unit by dividing the unit into a plurality of pieces is heretofore disclosed (see, e.g., JP-Tokukai-2002-351240A and JP-Tokukai-2003-255731A).

JP-Tokukai-2002-351240A discloses an induction heating fixing device comprising a magnetic material core and an induction coil that is divided into a plurality of pieces in a direction vertical to a paper passing direction. In the device, ends of the induction coils are inclined at a predetermined angle with respect to a direction vertical to a recording paper passing direction, whereby an electric current is allowed to pass through all of the divided induction coils to heat the heating roller.

Further, JP-Tokukai-2003-255731A discloses an induction heating fixing device as described below. That is, inside a hollow heating roller, an internal induction coil is arranged throughout the axial direction of the heating roller so that the coil is prevented from being brought into contact with the roller. Outside the heating roller, an external induction coil is arranged throughout the axial direction of the heating roller so that the coil is prevented from being brought into contact with the roller. Further, both of the induction coils are arranged so that the directions of the induction coils are changed to allow magnetic fluxes generating through both the induction coils to be shifted from each other by 90°.

However, according to the prior development as described above, when the induction coils adjacent to each other in the axial direction of the heating roller are brought into contact with each other, magnetic fluxes generating through each induction coil pass throughout the axial direction of the heating roller. As a result, the whole heating roller is always heated. Accordingly, an interval for separating the respective adjacent induction coils from each other must be provided. However, when providing the interval, a portion having no induction magnetic field, namely, a non-heating portion is formed on the heating roller. In the non-heating portion, temperature drop is caused. Accordingly, there arises a problem that a temperature distribution in the axial direction of the heating roller is made nonuniform, and as a result, fixing failure is caused.

SUMMARY OF THE INVENTION

In view of the foregoing, it is an object of the present invention to provide an induction heating fixing device where when arranging induction heating magnetic flux generating unit by dividing the unit into a plurality of pieces, temperature drop in a non-heating portion of the heating roller can be suppressed to keep uniform a temperature distribution in the axial direction of the heating roller. It is another object of the present invention to provide an image forming apparatus having the fixing device.

The object of the present invention can be achieved by the following Structure:

(1) An induction heating fixing device comprises:

a heating member for heating a recording medium while rotating along a paper passing direction, and an induction heating unit for heating the heating member, wherein the heating unit has a plurality of induction coils arranged by being divided in an axial direction of the heating member, the plurality of induction coils comprises an internal induction coil arranged inside the heating member and an external induction coil arranged outside the heating member, and the internal induction coil and the external induction coil are arranged so as to overlap each other in the axial direction of the heating member.

(2) An induction heating fixing device comprises:

a heating member for heating a recording medium while rotating along a paper passing direction, and an induction heating unit for heating the heating member, wherein the heating unit has a plurality of induction coils arranged by being divided in an axial direction of the heating member, and the plurality of induction coils are arranged so that magnetic fluxes at adjacent ends overlap each other and pass through the heating member.

BRIEF DESCRIPTION OF THE DRAWINGS

The present invention will be more fully understood from the detailed description given hereinbelow and the appended drawings which given by way of illustration only, and thus are not intended as a definition of the limits of the present invention, and wherein.

DETAILED DESCRIPTION OF THE PREFERRED EMBODIMENTS

Figure 1:
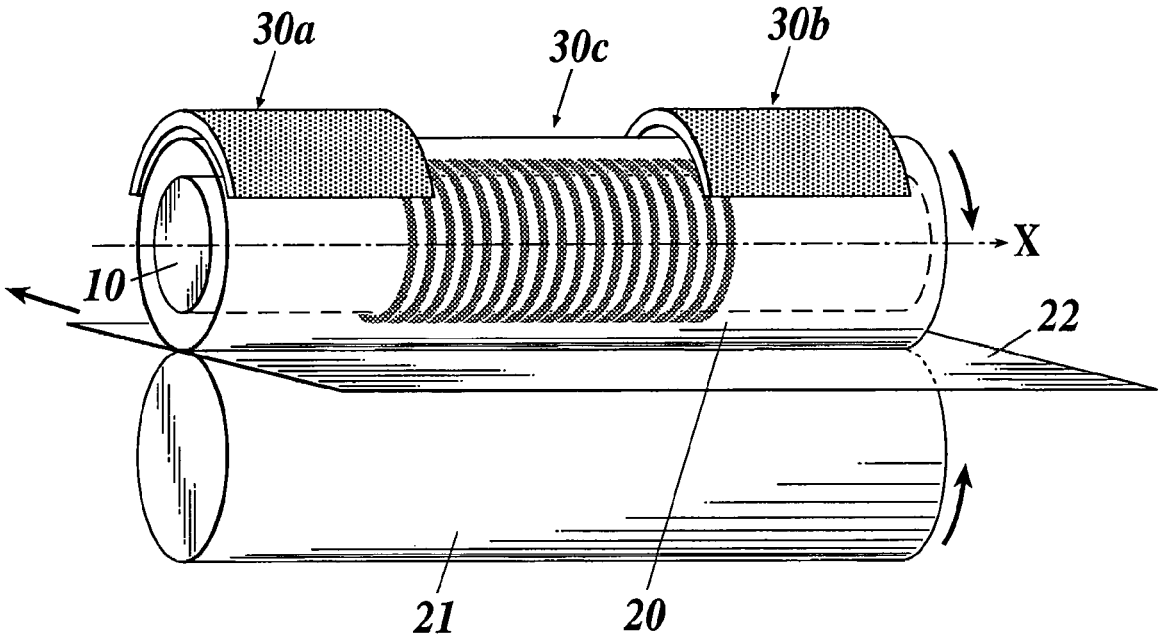
FIG. 1 is an outside construction view of a heating roller according to an embodiment of the invention.

Preferred embodiments of the present invention are described in detail below by referring to the drawings.

Figure 2:
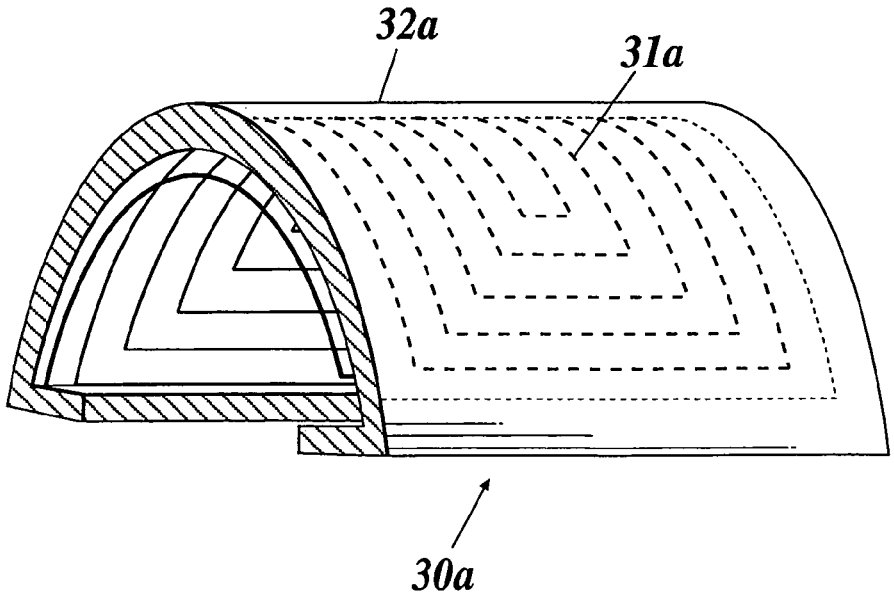
FIG. 2 is a perspective view of magnetic flux generating unit arranged outside a heating roller according to an embodiment of the invention.

First, an outline of a heating roller according to embodiments of the present invention is described by referring to FIGS. 1 and 2.

FIG. 1 shows an outside construction view of a heating roller according to an embodiment of the present invention.

As shown in FIG. 1, a heating roller 20 as a heating member is metallic and is formed to have a cylindrical shape. The heating roller 20 makes a pair with a pressure roller 21 as a pressure member. In a nip portion formed in a mutual rolling contact portion on peripheral surfaces of the rollers, the rollers 20 and 21 heat and fix toner on recording paper (a recording medium) 22 to be passed. Inside the heating roller 20, a magnetic flux generating unit 30*c* as a heating unit provided on a supporter 10 is arranged. Outside the heating roller 20, magnetic flux generating units 30*a* and 30*b* as the heating unit are arranged on each end of the heating roller 20 in an axial direction X thereof.

FIG. 2 shows a perspective view of the magnetic flux generating unit 30*a* arranged outside the heating roller 20 according to the embodiment of the present invention.

As shown in FIG. 2, the magnetic flux generating unit 30*a* comprises a magnetic material core 32*a* and a first induction coil 31*a* that is wound in the planar direction of the magnetic material core 32*a*. Further, the unit 30*a* is curved around an outer peripheral surface of the heating roller 20. Incidentally, the magnetic flux generating unit 30*b* has the same structure as that of the unit 30*a*, and therefore, the illustration and description thereof are omitted.

Figure 3:
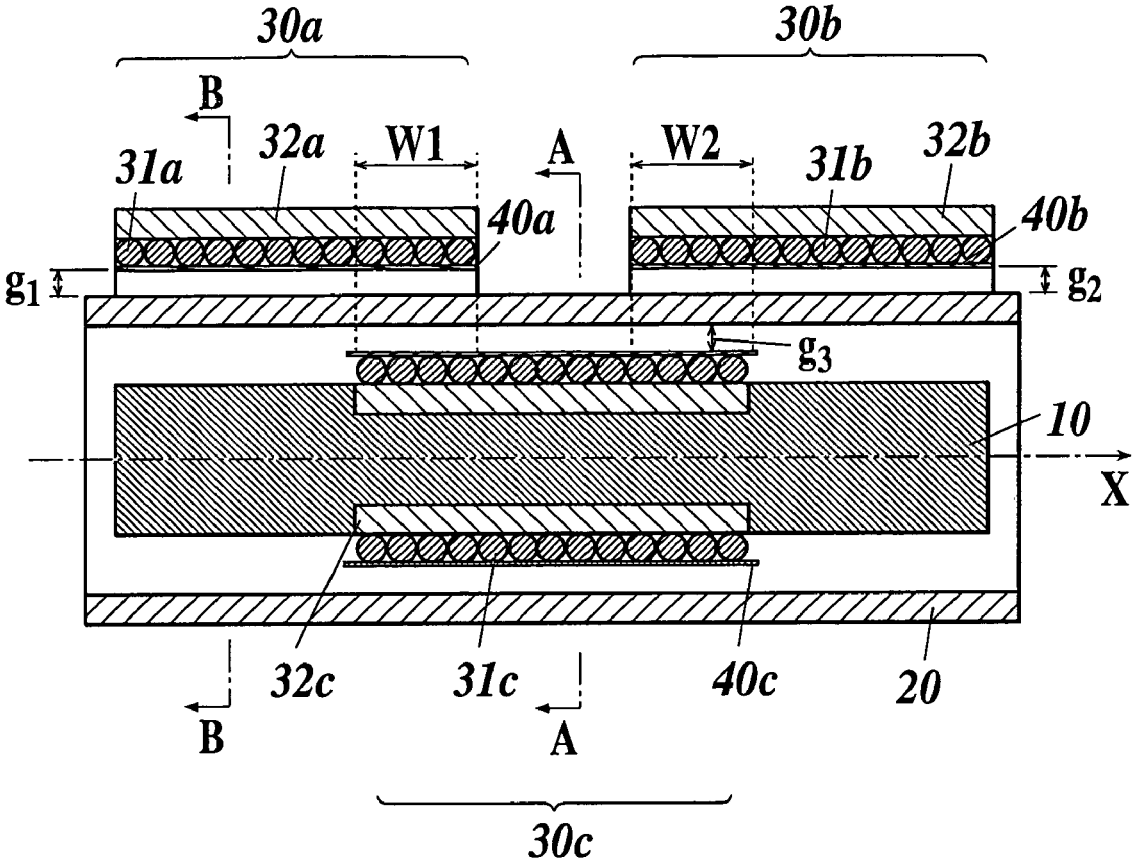
FIG. 3 is a longitudinal sectional view in an axial direction of a heating roller according to an embodiment of the invention.
Figure 4A:
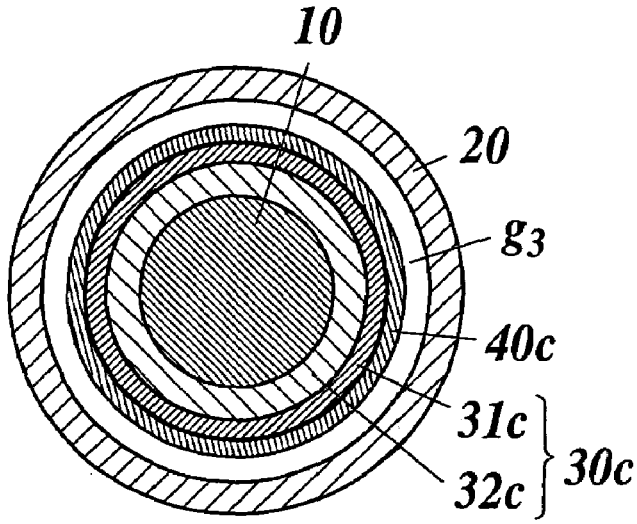
FIG. 4A is a sectional view taken on line A-A in FIG. 3.
Figure 4B:
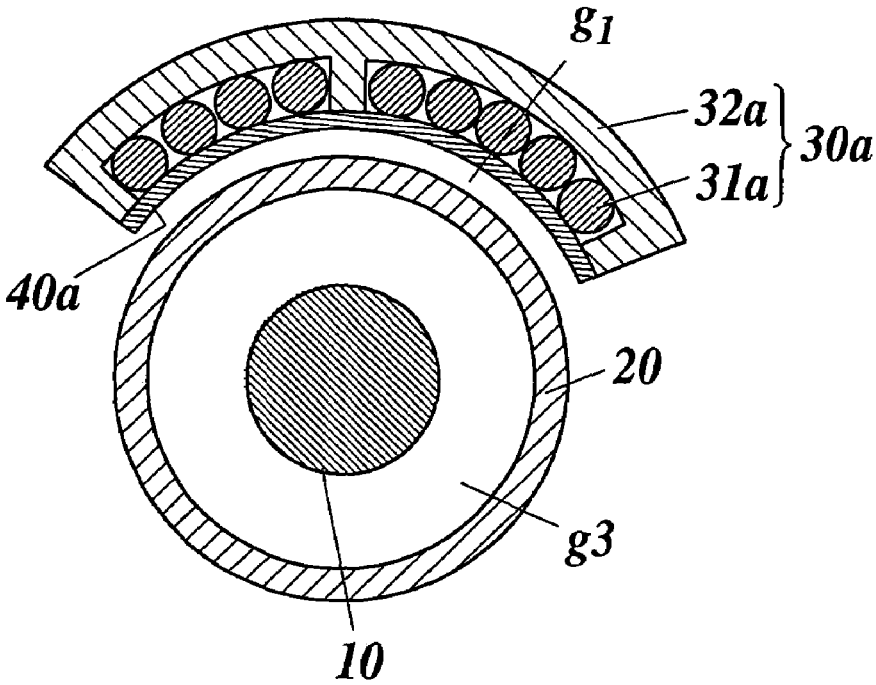
FIG. 4B is a sectional view taken on line B-B in FIG. 3.

Next, a detailed structure of the heating roller 20 according to the present invention is described by referring to FIG. 3 and FIGS. 4A and 4B. FIG. 3 shows a longitudinal sectional view in the axial direction X of the heating roller 20 according to the embodiment of the present invention. FIG. 4A shows a sectional view taken on line A-A in FIG. 3. FIG. 4B shows a sectional view taken on line B-B in FIG. 3.

As shown in FIG. 3, a supporter 10 is stored inside the heating roller 20 along the axial direction X of the heater 20. The magnetic flux generating unit 30*c* is provided in the central portion of the supporter 10. The magnetic flux generating unit 30*c* comprises a magnetic material core 32*c* provided in the central portion of the supporter 10 and a third induction coil 31*c* wound around the periphery of the magnetic material core 32*c* in the peripheral direction. The external peripheral surface of the coil 31*c* is covered with an insulator 40*c* comprising electrical insulating materials, in order to prevent an electric short due to contact with an internal peripheral surface of the roller 20. The unit 30*c* is stored inside the heating roller 20 while keeping a constant gap (gap g3) between an external peripheral surface of the insulator 40*c* and an internal peripheral surface of the heating roller 20.

The unit 30*a* comprises the magnetic material core 32*a* and the first induction coil 31*a* provided on the internal peripheral surface side of the core 32*a*. A surface of the coil 31*a* opposite the heating roller 20 is covered with an insulator 40*a* comprising electrical insulating materials. A constant gap (gap g1) is provided between the insulator 40*a* and an external peripheral surface of the heating roller 20 so that an electrical short circuit between the first induction coil 31*a* and the heating roller 20 can be prevented.

The magnetic flux generating unit 30*b* comprises a magnetic material core 32*b*, a second induction coil 31*b* and an insulator 40*b*. A gap g2 is provided between the insulator 40*b* and an external peripheral surface of the heating roller 20. The unit 30*b* has the same structure as that of the unit 30. Therefore, a detailed description thereof is omitted.

As shown in FIG. 3 and FIGS. 4A and 4B, the first induction coil 31*a* and the third induction coil 31*c* are arranged at a position (refer to symbol W1) where an end of the coil 31*a* and one end of the coil 31*c* overlap radially with each other. Similarly, the second induction coil 31*b* and the third induction coil 31*c* are arranged at a position (refer to symbol W2) where an end of the coil 31*b* and the other end of the coil 31*c* overlap radially with each other.

In other words, in the heating roller 20 surface corresponding to the overlap W1, the first induction coil 31*a* and the third induction coil 31*c* are adjacently arranged so that the magnetic flux through the coil 31*c* and that through the coil 31*a* overlap each other to pass through the heating roller 20. Similarly, in the heating roller 20 surface corresponding to the overlap W2, the second induction coil 31*b* and the third induction coil 31*c* are adjacently arranged so that the magnetic flux through the coil 31*c* and that through the coil 31*b* overlap each other to pass through the heating roller 20. Therefore, a non-heating portion is prevented from being present along the axial direction X of the heating roller 20.

Incidentally, a shape of the supporter 10 stored in the axial direction X of the heating roller 20 is not limited to that shown in FIG. 1. When using the supporter having thermal resistance, the same effect can be expected.

Figure 5:
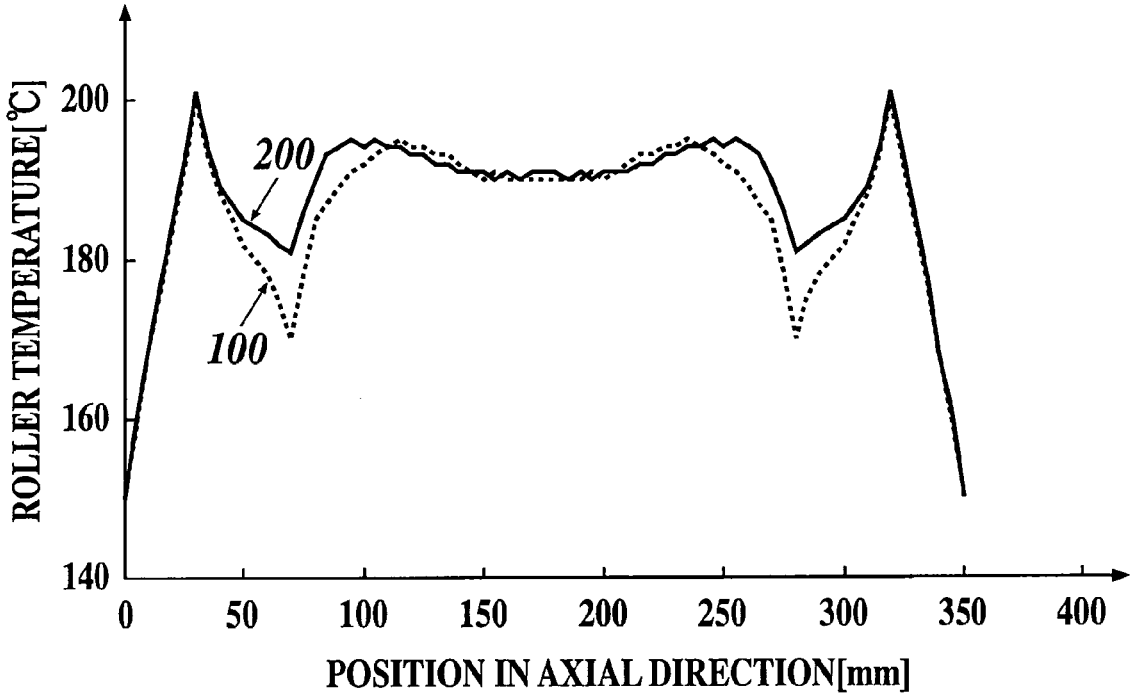
FIG. 5 is a graph showing an example of a temperature distribution in an axial direction of a heating roller surface.
Figure 6:
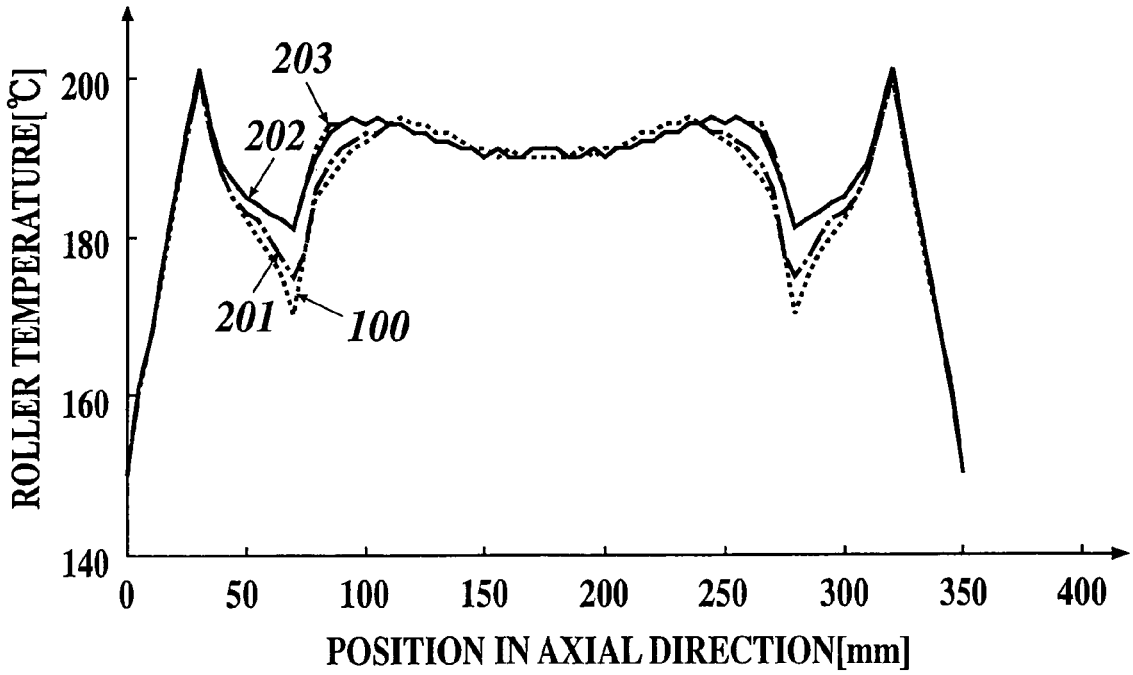
FIG. 6 is a graph showing an example of a temperature distribution of a heating roller surface when changing lengths of overlaps.

Next, an example of a temperature distribution in the axial direction X of the heating roller surface when applying the present embodiment is described by referring to FIGS. 5 and 6.

FIG. 5 shows an example of a temperature distribution in the axial direction X of the heating roller surface.

In FIG. 5, a broken line 100 indicates a temperature distribution in the axial direction X of the heating roller surface when using an prior fixing device. Further, a solid line 200 indicates a temperature distribution in the axial direction X of the heating roller 20 surface when using a fixing device according to the present embodiment.

The measurement conditions of the temperature distribution in FIG. 5 are as follows. In the prior fixing device and the fixing device of the present embodiment, 500 sheets of A4 size recording paper are passed in the cross-feed direction in a state where all induction coils are energized. At that time, temperatures on the heating roller surfaces are measured.

The prior fixing device as a control has a structure so that inside the hollow heating roller, three induction coils which are divided in the axial direction of the heating roller and installed only inside the heating roller are provided. The three induction coils comprise one induction coil which is provided in the center of the axial direction and wound (longitudinal winding) along the axial direction of the heating roller, and two induction coils which are provided on each end of the heating roller in the axial direction thereof and wound in the peripheral direction of the heating roller. Further, each of the three induction coils has a core in the inside thereof. At the ends (seams) where the three cores are adjacent to each other, the cores have end surfaces at a predetermined angle from the axial direction of the heating roller, and the end surfaces of the respective adjacent cores overlap in the axial direction.

As a further contrast, the prior fixing device and the fixing device of the present embodiment have the following structure. In both of the devices, the three induction coils are provided at the same position. Respective induction coils in the fixing device of the present embodiment overlap at the seam in the axial direction. On the other hand, respective induction coils in the prior fixing device are prevented from overlapping at the seam in the axial direction.

From FIG. 5, the following facts are found. That is, according to the prior fixing device (broken line 100), a sharp temperature drop is observed in the non-heating portion.

To the contrary, according to the fixing device of the present embodiment (solid line 200), a temperature drop is suppressed in the heating roller 20 surfaces corresponding to the overlaps W1 and W2 of respective induction coils, so that a temperature change can be suppressed up to a level where no effect is exerted on an image formation (fixing). Particularly, in this case, the prior fixing device cannot keep a temperature (180° C.) required as a fixing temperature. However, the fixing device according to the present embodiment can keep a temperature required as a fixing temperature and further can attain uniformity of the temperature distribution in the axial direction X of the heating roller 20.

Next, FIG. 6 shows an example of a temperature distribution in the axial direction X of the heating roller surface when changing the lengths of the overlaps W1 and W2 of the respective induction coils.

In FIG. 6, the broken line 100 indicates a temperature distribution in the axial direction of the heating roller surface when using the prior fixing device. The measurement conditions and prior fixing device in FIG. 6 are the same as those in FIG. 5. A dashed line 201, a solid line 202 and a chain double-dashed line 203 indicate a temperature distribution in the axial direction X of the heating roller 20 surface when the overlaps W1 and W2 are 5 mm, 10 mm and 15 mm in the fixing device of the present embodiment, respectively.

As described above, according to the fixing device of the present embodiment, a difference depending on the lengths of the overlaps W1 and W2 is observed in the temperature distribution. However, in any case, it is apparent that the temperature drop in the heating roller 20 surfaces corresponding to the overlaps W1 and W2 is suppressed as compared with the prior fixing device so that uniformity of the temperature distribution in the axial direction X of the heating roller 20 can be attained. Further, when the lengths of the overlaps W1 and W2 are 10 mm or more, a temperature (180° C.) required as the fixing temperature can be kept, and therefore, it is particularly preferred.

According to the above-described embodiments, a presence of the non-heating portion can be excluded and therefore, there can be realized an induction heating fixing device that is uniform in the temperature distribution in the axial direction X of the heating roller 20 and is excellent in thermal efficiency. Further, the induction coil comprises the third induction coil 31*c*, the first induction coil 31*a* and the second induction coil 31*b*. Therefore, a degree of freedom for designing a coil arrangement can be secured. At the same time, the surfaces corresponding to the overlaps W1 and W2 of the heating roller 20 can be efficiently heated from both the outside and the inside, and as a result, the temperature distribution in the axial direction X of the heating roller 20 can be further uniformized. In addition, a facing gap between the external first induction coil 31*a* or second induction coil 31*b* and the heating roller 20 can be made constant. Therefore, the temperature distribution in the axial direction X of the heating roller 20 can be uniformized. Further, the temperature drop from the temperature (180° C.) required as the fixing temperature in a particular surface of the heating roller 20 can be suppressed.

Incidentally, in the present embodiment, the third induction coil 31*c* is wound in the peripheral direction of the heating roller 20. Further, the coil 31*c* may be wound by another method such as a method of winding it in the axial direction X of the heating roller 20.

Further, in the present embodiment, the first induction coil 31*a* and the second induction coil 31*b* are arranged outside the heating roller 20. The coils 31*a* and 31*b* may be arranged inside the heating roller 20, and the third induction coil 31*c* may be arranged outside the heating roller 20. Further, in the present embodiment, the three induction coils of the first induction coil 31*a*, the third induction coil 31*c* and the second induction coil 31*b* are provided along the axial direction X of the heating roller 20. The induction coils divided into two or four or more pieces may be provided along the axial direction of the heating roller.

Further, an image forming apparatus such as a copier and a printer may be constructed by providing an image forming unit that develops a toner image of image data on a photoreceptor drum and transfers the toner image to a recording paper (recording medium), and the induction heating fixing device according to the present embodiment. According to the image forming apparatus, the induction heating fixing device can realize fixing performance that is uniform in the temperature distribution and is excellent in the thermal efficiency to a recording paper where a toner image is formed in the image forming unit.

The entire disclosure of Japanese Patent Application Publication Tokugan-2004-320841 filed on Nov. 16, 2004 and Japanese Patent Application Publication Tokugan-2005-197591 filed on Jul. 6, 2005, including specification, claims, drawings and summary are incorporated herein by reference in its entirety.

What is claimed is:

1. An induction heating fixing device comprising:

a heating member for heating a recording medium while rotating along a paper passing direction, and an induction heating unit for heating the heating member, wherein:

the heating unit has a plurality of induction coils, each having a corresponding magnetic material core, arranged by being divided in an axial direction of the heating member, the plurality of induction coils comprises an internal induction coil arranged inside the heating member and an external induction coil arranged outside the heating member, and the magnetic material core of the internal induction coil and the magnetic material core of the external induction coil are arranged so as to overlap each other in the axial direction of the heating member.

2. The induction heating fixing device of claim 1, wherein the external induction coil is curved around a peripheral surface of the heating member so as to cover a part thereof.

3. The induction heating fixing device of claim 1, wherein the respective induction coils are adjacently arranged so that magnetic fluxes overlap each other in a surface of the heating member.

4. An image forming apparatus comprising the induction heating fixing device of claim 1.

* * * * *